US005328356A

United States Patent [19]

Hawkinson

[11] Patent Number: 5,328,356

[45] Date of Patent: Jul. 12, 1994

[54] GAS BURNER SYSTEM

[75] Inventor: Eric Hawkinson, Mt. Pleasant, Iowa

[73] Assignee: Heatilator, Inc., Mt. Pleasant, Iowa

[21] Appl. No.: 989,168

[22] Filed: Dec. 11, 1992

[51] Int. Cl.[5] ..... F23Q 2/32

[52] U.S. Cl. ..... 431/125; 126/92 R; 126/512

[58] Field of Search ..... 126/512, 92 R, 92 AC, 126/91 R, 91 A, 85 B, 531, 39 R, 90 R, 503; 431/125, 110, 112, 326, 328, 329

[56] References Cited

U.S. PATENT DOCUMENTS

| | | | |
|---|---|---|---|
| 1,156,735 | 10/1915 | Wilson | 126/512 |
| 4,838,240 | 6/1989 | Rieger | 126/512 |
| 4,838,241 | 6/1989 | Rieger | 126/512 |
| 4,940,407 | 7/1990 | Rehberg et al. | 126/512 |
| 5,000,162 | 3/1991 | Shimek et al. | 126/512 |

FOREIGN PATENT DOCUMENTS

| | | | |
|---|---|---|---|
| 2198836 | 6/1988 | United Kingdom | 126/92 R |

*Primary Examiner*—James C. Yeung

*Attorney, Agent, or Firm*—Jones, Day, Reavis & Pogue

[57] ABSTRACT

A burner pan comprises a large top plate conforming to the entire burner area for providing convenient support for the logs and wide flexibility in the configuration and location of the gas flame ports. The burner pan comprises a plurality of gas ports disposed along the outer periphery of the top plate, a burner plenum subjacently disposed along the outer periphery of the top plate for delivering gas to the gas ports, and a dead air space in the center of the burner pan. The burner plenum is formed between a shallow gas-tight outer housing shell which defines the outer peripheral walls of the burner plenum and a smaller inner shell adapted to fit within the outer shell which defines the inner peripheral walls of the burner plenum and circumscribes a substantially sealed central dead air space which is essentially free from the burner gas.

20 Claims, 4 Drawing Sheets

GAS BURNER SYSTEM

FIELD OF THE INVENTION

The present invention relates generally to gas fireplace systems and more particularly to gas burner systems for use in gas fireplaces.

BACKGROUND OF THE INVENTION

Gas fireplaces are well known and typically include a gas burner positioned beneath a plurality of artificial logs, typically made of a non-combustible material, such as ceramic or cement, to simulate the appearance of natural wood logs. One type of gas burner is the "sand pan burner" in which the gas nozzles are buried below the surface of a non-combustible material such as sand or vermiculite contained in a relatively large shallow pan. The gas permeates and disperses through the material and ignites upon entering the atmosphere, thereby creating an orange/yellow flame dispersed over the bed of material and simulating a bed of glowing embers such as coals or ashes. Other types of gas burners include straight and U-shaped gas delivery tubes and pan-shaped burners comprising a plurality of gas ports to produce flames underneath the logs. The gas ports have been configured as a single slot-shaped port, a single row of circular ports or a plurality of uniformly or symmetrically distributed ports.

A natural wood burning fire has certain characteristics including a non-symmetrically distributed flame in which the flames will typically "flicker" so that one portion of fire has a relatively concentrated flame pattern while another portion has a relatively sparse flame concentration. In addition, some of the flames in a natural fire will be taller and/or wider than other flames and will directly impinge on the logs or will appear to emanate from the logs. The fire will also have a "glowing" bed of coals or embers emitting a smaller flame pattern than the logs.

Conventional gas fireplaces have been largely unsuccessful in simulating the pleasing aesthetic appearance of a wood-burning fire, especially with respect to the natural flickering flame pattern and the non-symmetrical distribution of the fire because many typical gas burner systems produce a homogenous and symmetrical distribution of flames. Since direct impingement of the flame on the artificial logs typically cools the flame and creates a highly inefficient and dirty yellow flame and unacceptable levels of soot and carbon monoxide (CO), attempts to direct the gas flame away from the logs and redistribute the flame concentration including, for example, flame deflectors, have only enhanced the poor simulation of a natural wood fire.

Typical gas burners have other problems in addition to the poor simulation of a natural wood burning fire. Not only are the gas burners relatively expensive to manufacture but the U-shaped and straight gas burners require a relatively complex system of grates and/or pins to insure that the logs are properly positioned and mounted above the gas burner. In other instances, the artificial logs are not interchangeable between gas burners and must be specially manufactured to fit with the specific gas burners. Many gas burners, especially the large pan-shaped burners, are inefficient and poorly designed to have relatively large internal gas plenums. When the fireplace is turned off, the gas remaining inside the plenum is inefficiently burned or otherwise disposed. In other instances, the entire volume of gas may ignite simultaneously to create an undesirable "flash burn" inside the fireplace or, if the flame is extinguished, escape into the room.

OBJECTS AND SUMMARY OF THE INVENTION

It is an object of the present invention to provide a gas burner system which provides the broad support of a pan-shaped burner and which efficiently utilizes the gas and minimizes the gas volume stored by the gas burner.

Another object of the present invention is to provide a gas burner system which simulates a natural wood burning fire.

It is a more particular object of the present invention to provide a gas burner system which simulates the shape and distribution of a natural wood burning fire including the flickering flame pattern having concentrated flame sections and sparse flame sections.

A similar object is to provide a gas burner system which simulates the glowing embers and coals produced by a natural wood burning fireplace.

It is a further object to provide a gas burner system which generates a flame which directly impinges on the logs like a natural wood burning fire.

Another object is to provide a gas burner system which can be easily and inexpensively manufactured.

Yet another object to provide a gas burner system which supports the logs without a complicated mounting and supporting system.

A more particular object is to provide a gas burner system which can accept logs of all sizes and shapes and which does not require specially manufactured logs.

The gas burner system made in accordance with the present invention comprises a gas burner pan and a plurality of logs placed thereon for use in any conventional gas fireplace. The burner pan comprises a large top plate conforming to the entire burner area for providing convenient support for the logs and wide flexibility in the configuration and location of the gas flame ports. The gas burner pan comprises a plurality of gas ports disposed along the outer periphery of the top plate, a burner plenum which traverses the subjacent areas of the gas ports for delivering gas to the gas ports, and a dead air space in the center of the burner pan in which gas is substantially excluded for minimizing the flow of the burner gas through the burner plenum. The burner plenum is formed between a shallow gas-tight outer housing shell which defines the outer peripheral walls of the burner plenum and a smaller inner shell configured to fit within the outer shell and which defines the inner peripheral walls of the burner plenum and circumscribes a substantially sealed central dead air space which is essentially free from the flow of burner gas.

In accordance with another object of the present invention, the gas burner pan has a plurality of gas ports arranged in such a manner as to provide a realistic simulation of a natural wood burning fire. Unlike conventional gas burners which utilize a single slot-shaped port, a single row of circular ports or a plurality of uniformly and symmetrically distributed ports, the present gas burner has a plurality of gas ports disposed on the top panel in discretely distributed sections in order to create concentrated flames in some sections and relatively sparse flames in other sections. The flame concentration and distribution generated by each section can be varied and controlled by the arrangement, the number and the size of the gas ports. In a preferred embodiment, the gas burner pan produces a fire having three concentrated flame sections created by three rear gas port sections, front flames created by front gas ports disposed in the front panel, and sparse flame sections created by carryover ports disposed along the outer periphery of the top plate and the front gas ports.

In order to simulate the glowing coals and embers typically generated by a natural wood burning fireplace, the gas burner pan has a front trough containing vermiculite. The vermiculite is placed in the trough in front of and below the front gas ports so that the front flame impinges on the top of the bed of vermiculite to simulate a glowing ember appearance.

In accordance with another object of the present invention, the gas ports and logs are arranged so that the gas flames directly impinge on the logs. In general, the logs may be arranged on the outer burner pan in any desired manner as long the logs do not interfere with the operation of the gas ports and the gas flames impinge directly on the logs.

These and other features and advantages of the invention will be more readily apparent upon reading the following description of a preferred exemplified embodiment of the invention and upon reference to the accompanying drawings wherein:

While the invention will be described and disclosed in connection with certain preferred embodiments and procedures, it is not intended to limit the invention to those specific embodiments. Rather it is intended to cover all such alternative embodiments and modifications as fall within the spirit and scope of the invention.

DETAILED DESCRIPTION OF THE PREFERRED EMBODIMENT

Figure 1:
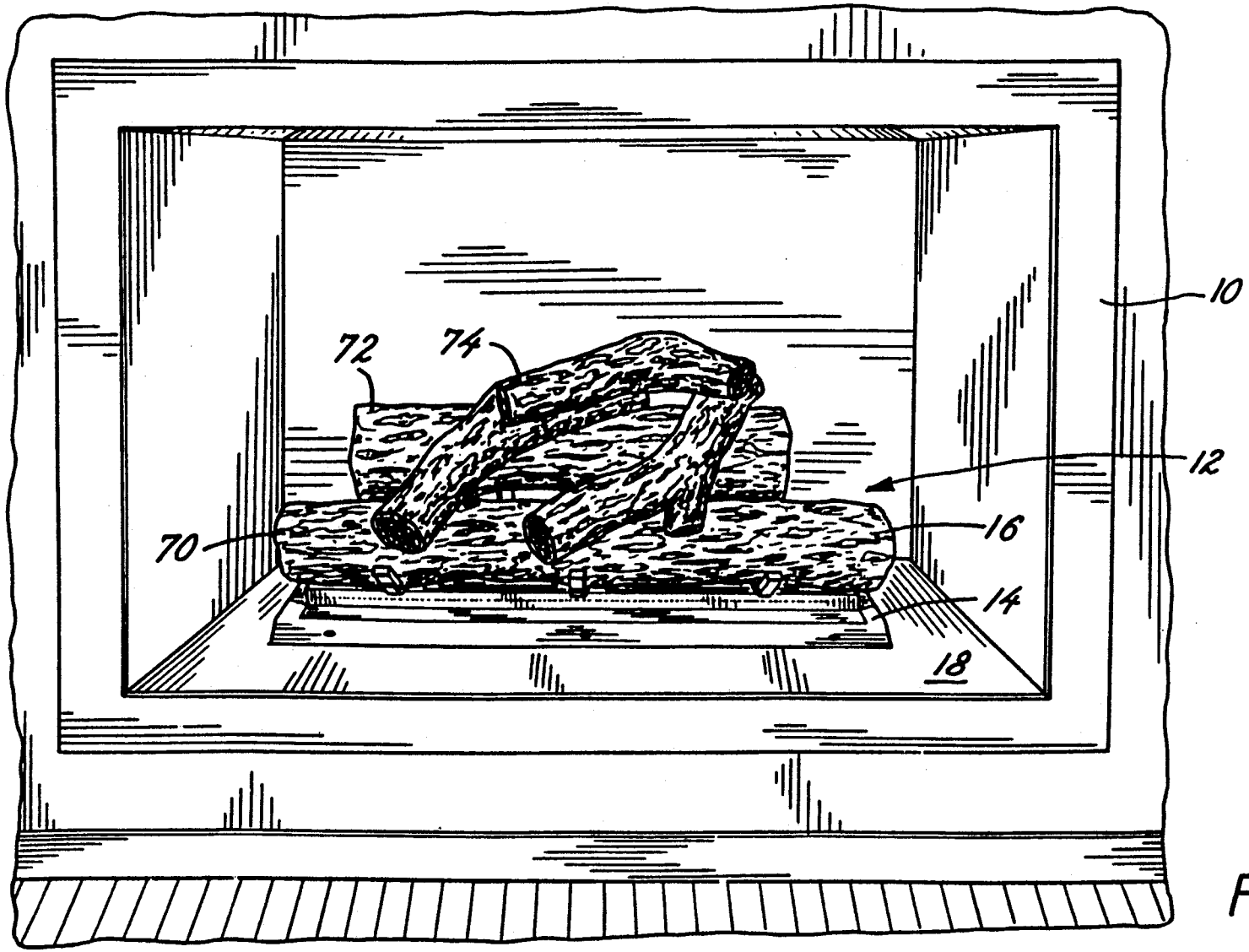
FIG. 1 is a front elevational view of a conventional gas fireplace having a first embodiment of a gas burner system made in accordance with the present invention.

Turning to the figures, FIG. 1 illustrates a conventional fireplace 10 having one embodiment of a gas burner system 12 including a pan burner 14 and artificial logs 16 made in accordance with the present invention. Referring also to FIGS. 2–5, the burner pan 14 comprises a large top plate 32 conforming substantially to the entire burner area for providing convenient support for the logs 16 and wide flexibility in the configuration and location of the gas flame ports 30. The burner pan 14 defines a burner plenum 20 which traverses the subjacent areas of the flame ports 30 to deliver gas thereto and at least one dead air space 44 in which gas flow is substantially excluded for minimizing the volume of the burner pan 14 receiving the burner gas. Although the burner plenum 20 and the dead air space 44 may have any configuration such that the plenum 20 is subjacent the gas ports 30 and capable of delivering sufficient quantities of gas to the gas ports 30 and the dead air space 44 does not interfere with the distribution of the gas to the gas ports 30 by the burner plenum 20, it is preferable that the volume of the burner plenum 20 be minimized and the volume of the dead air space 44 be maximized in order to eliminate or reduce the problems such as flashburn or escaping gas heretofore known in conventional gas burners.

Figure 2:
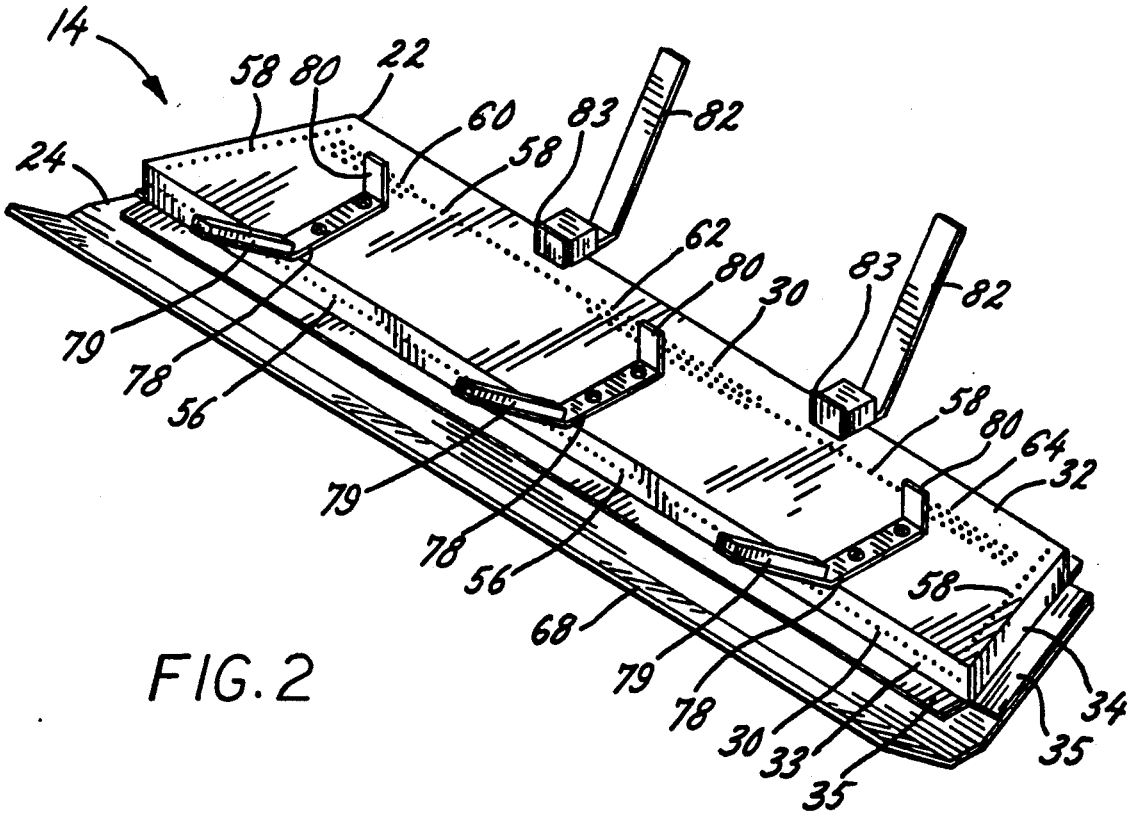
FIG. 2 is a perspective view of a first embodiment of the gas burner made in accordance with the present invention.
Figure 3:
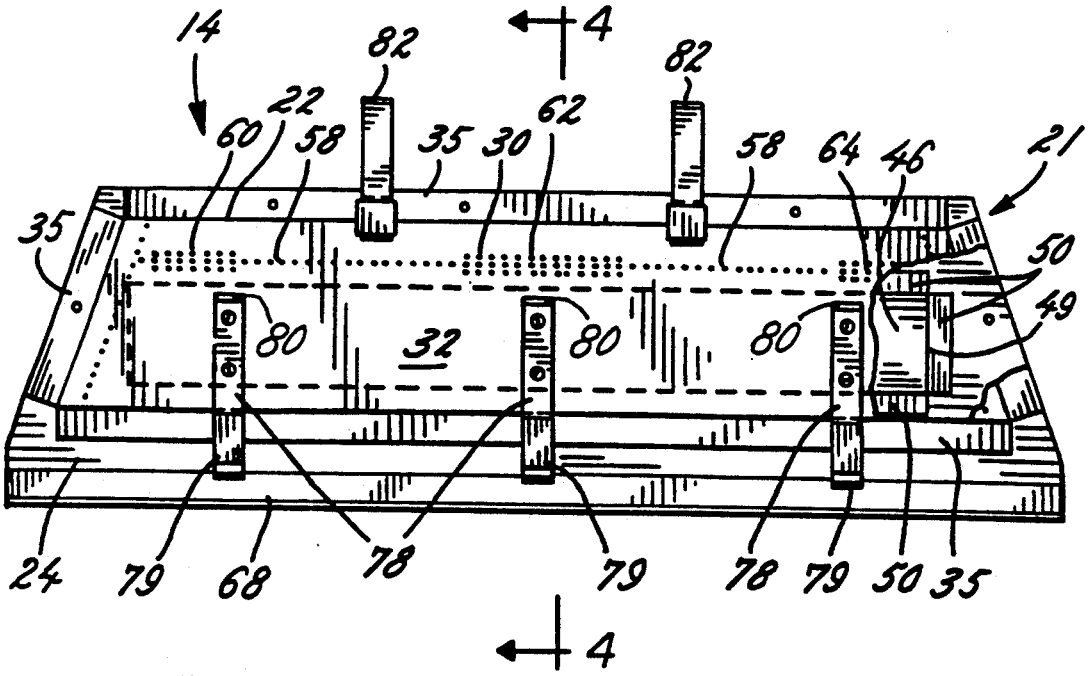
FIG. 3 is top plan view of the gas burner shown in FIG. 2, with part of the outer housing broken away to show the inner housing.
Figure 5:
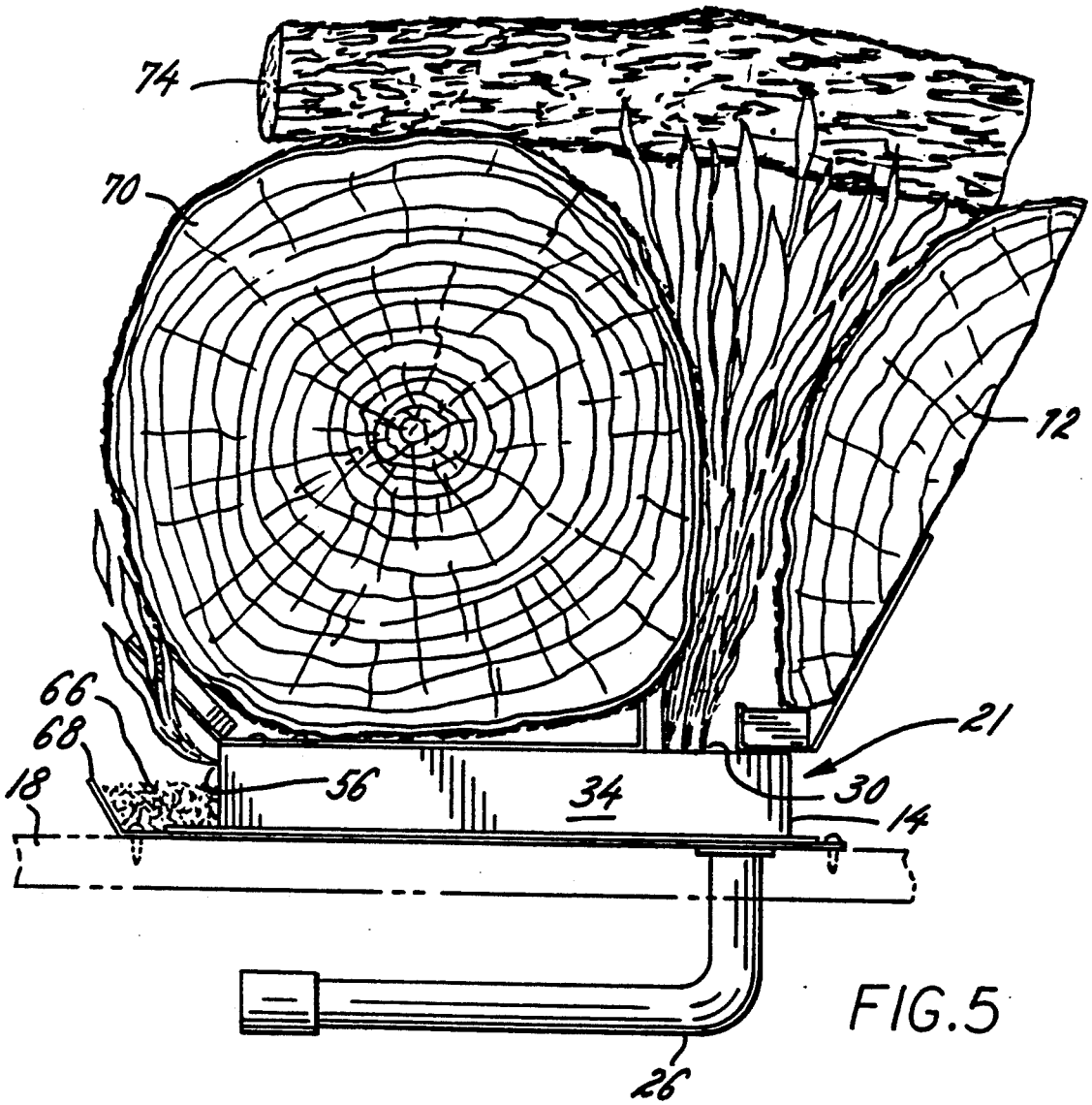
FIG. 5 is a side elevational view of the gas burner system and logs illustrated in FIG. 1.
Figure 4:
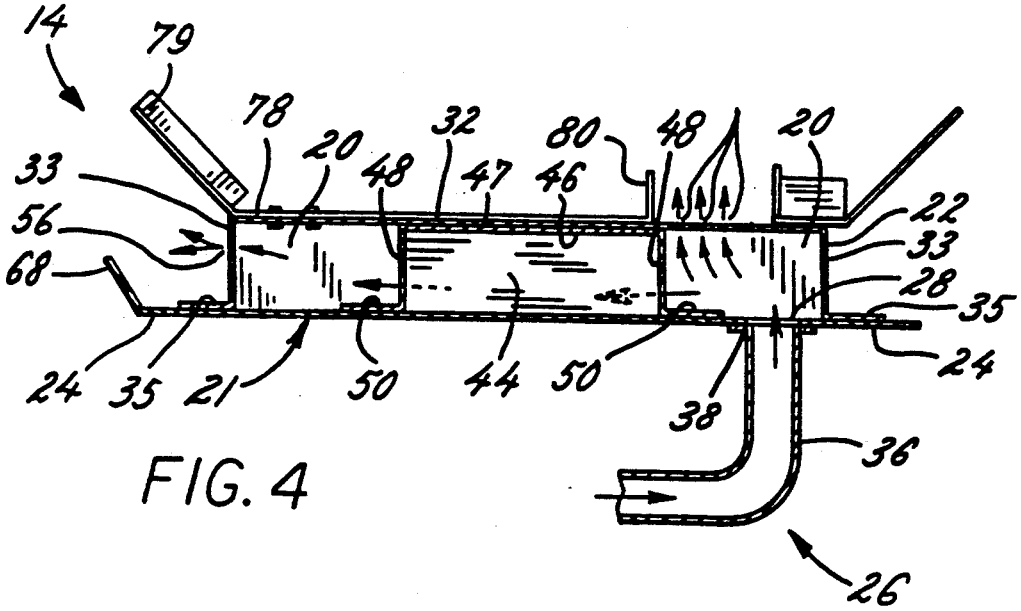
FIG. 4 is a cross sectional view of the gas burner taken along line 4—4 in FIG. 3.

In the first embodiment of the present invention illustrated in FIGS. 1–5, it will be seen that the burner pan 14 has a burner plenum 20 which is configured in a generally O-shape along the outer periphery of the burner pan and a dead air space 44 which is centrally disposed in the middle of the burner plenum 20. The gas burner pan 14 comprises a plurality of gas ports 30 disposed along the outer periphery of the top plate 32, a burner plenum 20 subjacently disposed along the outer periphery of the top plate 32 for delivering gas to the gas ports 30, and a dead air space 44 in the center of the burner pan 14 subjacent a portion of the top panel 32 free of any gas ports 30. The burner plenum 20 is formed between a shallow gas-tight outer housing shell 21 and a smaller inner housing shell 46 therewithin, as best shown in FIG. 4. The outer shell 21 defines the outer peripheral walls of the burner plenum 20. The inner shell 46 defines the inner peripheral walls of the burner plenum 20 and circumscribes a substantially sealed central dead air space 44 which is substantially free from the burner gas.

The gas-tight outer housing shell 21 is formed by a generally flat bottom plate member 24 which is sealably joined to an opposed hat-shaped top member 22 to prevent gas from escaping from the burner plenum 20. The top member 22 includes the flat top panel 32, front and back opposed side panels 33 and opposed end panels 34. These components are suitably joined and preferably integral to effect the gas-tight enclosure such as by welding or other conventional means which are known to those skilled in the art. Flanges 35 may be provided on the side and end panels 33, 34 to facilitate joining of the bottom plate 24 and top member 22. The top member 22 provides a large stable platform for supporting the logs 16 without the need for any grates or other complicated mounting mechanisms typically required by conventional burner systems. Although the top panel 32 has a plurality of gas flame ports 30 disposed along the outer periphery thereof in the illustrated embodiment, the gas ports 30 may be disposed in any desired configuration or position on the top panel 32.

The bottom plate 24 and the top member 22 may be made in any shape which will accommodate the dimensions and shape of the interior combustion chamber of the gas fireplace 10. In the illustrated embodiment, each has a generally isosceles trapezoid shape in order to fit the floor 18 found in many conventional fireplaces. When placed on the floor 18, the pan 14 may be oriented so that it is level or it may be tilted so that the rear is higher than the front to better display the rear logs 16. The outer burner pan 22 and the bottom pan 24 may be made of any material, such as sheet metal, which is suitable for a gas fireplace environment and which meets any applicable regulations and codes.

Referring to FIG. 4, it will be seen that the generally hat-shaped inner housing shell 46 has a configuration smaller than the outer shell 21 in order to fit within the outer housing shell 21. The inner housing shell 46 has a flat top panel 47, opposing front and back side panels 48, and opposing end panels 49. The side panels 48 and the end panels 49 are affixed to the bottom pan 24 to define the dead air space 44 therebetween. The inner shell 46 may be connected to the bottom plate 24 using bolts, welding or other conventional means which minimizes or eliminates the flow or migration of gas by other than slow leakage from the burner plenum 20 into the dead air space 44 to provide a relatively gas-free space, or at least to prevent ready flow of gas into or out of the space 44. In the illustrated embodiment, the side and end panels 48, 49 of the inner pan 46 have flanges 50 projecting therefrom for facilitating joining of the inner shell and the bottom plate 24. The top panel 47 of the inner burner pan 46 is preferably subjacent the top panel 32 of the top member 22 as shown in FIG. 4 so that the side and end panels 48, 49 of the inner shell 46 may provide additional support for the top panel 32 of the top member 22 which must support the artificial logs 16.

Figure 6:
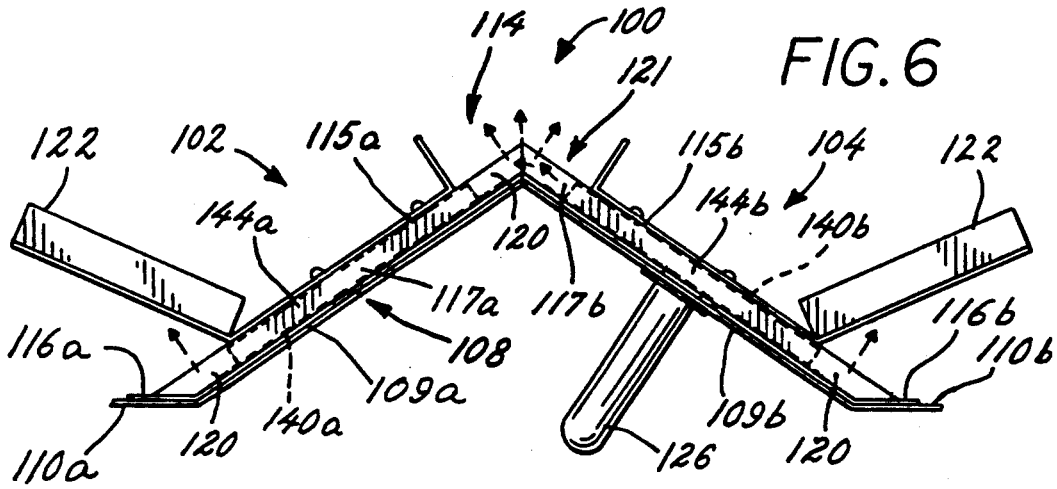
FIG. 6 is a side elevational view of a second embodiment of a gas burner pan made in accordance with the present invention.
Figure 7:
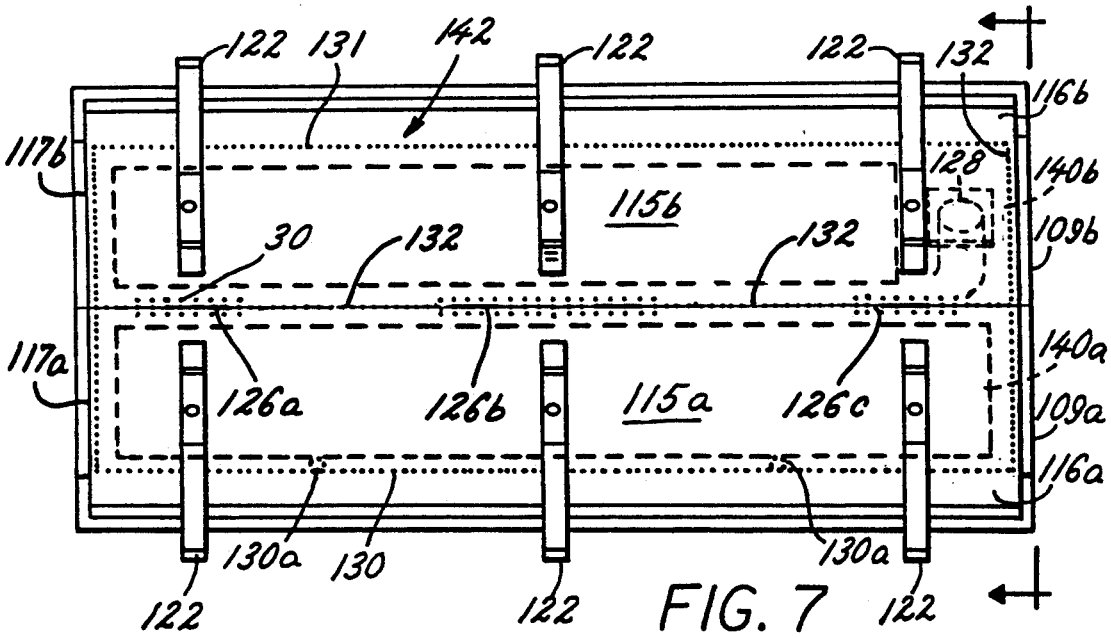
FIG. 7 is a top plan view of the gas burner pan shown in FIG. 6.
Figure 8:
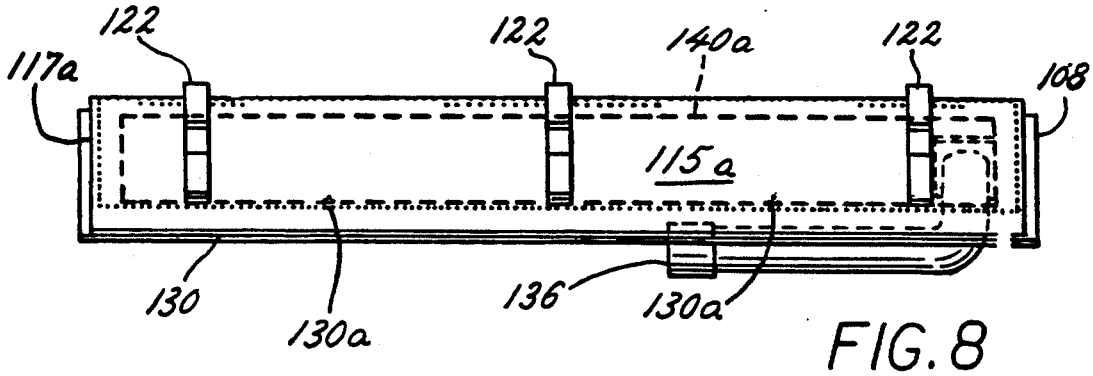
FIG. 8 is a front elevational view of the gas burner pan shown in FIG. 6.

In the second embodiment of the present invention illustrated in FIGS. 6–8, the burner pan 100 is adapted for a gas fireplace which is viewed from two sides and thus has left and right sections 102, 104 forming a generally V-shaped cross section. The burner pan 100 has a burner plenum 120 configured in a generally O-shape with a horizontal portion (when viewed in the plan view of FIG. 7) which is subjacent the gas ports 30 disposed along the outer periphery and the middle of the burner pan 14 and two dead air spaces 144*a*, 144*b* disposed with one in each section 102, 104. It will be appreciated that the second embodiment of the burner pan 100 basically comprises two burner pans made in accordance with the first embodiment which have been joined together at one of the sides so that the respective burner plenums are in communication with each other.

Specifically, the burner pan 100 comprises a gas tight V-shaped outer housing shell 121 for receiving gas therein formed by the bottom member 108 sealably joined to the top member 114. The top member 114 is formed by top panels 115*a*, 115*b*, end panels 117*a*, 117*b* and base members 116*a*, 116*b*. The bottom member 108 has bottom panels 109*a*, 109*b*, base members 110*a*, 110*b* for supporting the burner pan 100 above the floor of the fireplace, and a gas inlet 128 for receiving gas from the gas delivery means 136. Since the top panels 115 each typically support at least one log, brackets 122 are attached to each of the top panels 115 in order to support and align the logs thereon.

In order to form the burner plenum 120 and the dead air spaces 144 in the second embodiment, the burner pan 100 comprises two hat-shaped inner shells 140*a*, 140*b* disposed within the outer shell 121, which are identical to the inner shell 21 described in connection with the first embodiment. Each inner shell 140*a*, 140*b* is disposed in its respective sections 102, 104 so that it does not interfere with the operation of the gas ports 130.

It should now be appreciated that the present invention provides an efficient pan burner which minimizes the amount of gas necessary to fill the burner pan by separating the burner pan into a burner plenum which delivers gas to the gas ports and at least one dead air space which minimizes or eliminates the flow of gas therein. By minimizing the volume of gas flowing through the burner plenum, the present invention eliminates or substantially reduces the problems heretofore known in conventional burners.

Referring to the first embodiment in FIGS. 2–5, gas is delivered to the burner plenum 20 by a conventional gas delivery means 26 which, in the illustrated embodiments, comprises a gas supply (not shown) connected to a conventional gas feed line 36 and gas valve 38 for delivering gas into the burner plenum 20 through the gas inlet 28 located in the bottom plate 24. Primary combustion air is typically mixed with the gas in the feed line 36. The gas inlet 28 may be located anywhere in the plenum 20 but it is preferred that the gas inlet 28 be centrally located so that gas is evenly and efficiently distributed throughout the burner plenum 20. In the illustrated embodiment, the gas valve 38 is threadably connected to the bottom plate 24 using a gasket in order to facilitate assembly of the burner pan 14 but the gas valve 38 may be connected to the burner pan 14 by any conventional means which produces a gas tight seal. When the gas is delivered into the plenum 20, the gas expands and migrates throughout the plenum 20 and exits through the gas ports 30 located on the top member 22. In order to ignite the gas upon entry to the atmosphere, a conventional ignition system (not shown), centrally mounted to the gas burner pan 14 near the gas inlet 28, ignites the gas and the flame migrates to the adjacent gas ports 30 until all of the ports are fully ignited. The gas delivery means and ignition means are controlled by conventional controls and contain appropriate safety devices which are well known in the art.

It will be appreciated that a natural wood burning fire has certain characteristics. In sharp contrast to the uniformly and symmetrically distributed flame pattern created by many conventional gas fireplaces, the flames of a natural fire will typically have a "flickering" flame pattern in which one portion of the fire has a relatively concentrated flame pattern while another portion has a relatively sparse flame concentration. In addition, some of the flames in a natural fire will be taller and/or wider than other flames and will directly impinge on the logs or emanate from a glowing bed of embers or coals.

In accordance with one of the objects of the present invention, the gas burner pan has a plurality of gas ports 30 arranged in such a manner as to provide a realistic simulation of a wood burning fire. Unlike conventional gas burners which utilize a single slot-shaped port, a single row of circular ports or a plurality of uniformly or symmetrically distributed ports, the present gas burner pan has a plurality of gas ports 30 disposed on the top panel 32 in discretely distributed sections which provide concentrated flames in some sections and relatively sparse flames in other sections like the flickering flame pattern of a natural wood burning fire. The flame concentration and shape generated by each individual section can be varied and controlled by the configuration, the number and the size of the gas ports 30 in the respective section.

Referring to the first embodiment illustrated in FIG. 3, the outer shell 21 has a plurality of gas ports arranged in three gas port sections 60, 62, 64 at the rear of the top panel 32, a plurality of front gas ports 56 disposed on the front side panel 33 and a plurality of carryover ports 58 disposed on the outer periphery of the burner pan 14 for connecting the gas port sections 60, 62, 64 and the front gas ports 56. The three gas port sections 60, 62, 64 produce three concentrated flames at the rear of the gas burner pan 14. The front gas ports 56 produce a flame at the front of the gas burner pan 14. The primary purpose of the carryover ports 58 is to assist in the flame ignition by permitting the flame to migrate between the three rear sections 60, 62, 64 and the front gas ports 56, but they also produce flames having relatively sparse concentrations compared with the three rear sections 60, 62, 64. It will now be appreciated that the gas burner 14 simulates the flickering flame pattern of a wood burning fire by producing a fire having three concentrated rear flame sections created by the three rear sections 60, 62, 64, four relatively sparse flame sections created by the carryover ports 58 and a front wall of flames created by the front gas ports 56.

In the second embodiment, the gas ports 30 form three middle gas port sections **126*a*, 126*b*, 126*c* disposed in the middle of the top member 114, front and rear gas port sections 130, 131 disposed in the front and rear of the top member 114 and carryover ports 132 disposed in the top member 114 connecting the three middle gas port sections 126*a*, 126*b*, 126*c* and the front and rear gas port sections 128, 130. As in the first embodiment, each of the three middle gas port sections 126*a*, 126*b*, 126*c* comprise a plurality of gas ports 30 which will produce three concentrated flame areas, the front and rear gas port sections 130, 131 will create front and rear flames, and the carryover ports 132 will permit flame migration between the adjacent gas ports 30** during initial ignition and provide sparse flame patterns to further simulate the flickering flame pattern typically found in a natural wood burning fire.

The configuration, number and size of the gas ports 30 may be modified to provide any desired flame pattern including, for example, any number of interspersed concentrated or sparse flame sections disposed anywhere on the outer shell 21. In the first embodiment, each gas port section 60, 62, 64 may have a plurality of gas ports 30 arranged in a plurality of rows and columns. By changing the number and size of gas ports 30 in each section 60, 62, 64, the concentration and size of the flame can be varied. Similarly, the shape of the flame can be varied by controlling the configuration of the gas ports 30. In order to vary the distribution of the front flames, for example, a plurality of gas ports 30 may be grouped together in front sections **130*a* as shown in FIG. 7, thereby creating a non-symmetrical front flame pattern having slightly taller or wider flames disposed along the length of the fire. Since it is typically preferable that the rear flames be larger and taller than the front or side flames for aesthetic reasons, the ports 30 in the rear gas port sections 60, 62, 64 will typically be slightly larger than the carryover ports 58 or the front ports 56. It has been found that the gas burner system 12 will adequately simulate a wood burning fire if the gas ports in the rear gas ports 30 have a diameter of about 0.099 inches and the carryover ports 58 and the front ports 56 have a diameter of about 0.089 inches. The gas ports 30** may be formed by any suitable technique including, for example, drilling or punching.

In order to simulate the glowing coals and embers typically generated by a natural wood burning fireplace, the gas burner system 12 may have a trough 68 containing non-combustible particles such as vermiculite 66. As shown in FIGS. 2 and 4, the gas burner pan 14 has a flange 68 projecting from the front of the bottom plate 24 which forms a trough 66 for holding the vermiculite. When the flame generated by the front gas ports 56 impinges on the top of the bed of vermiculite, it provides a glowing ember appearance. Similar troughs may be provided in the second embodiment if desired.

In accordance with another object of the present invention and unlike many conventional gas fireplaces, the gas ports 30 and logs 16 are arranged so that the gas flames 16 directly impinge on the logs 16. In general, the logs 16 may be arranged on the outer shell 21 in any desired manner as long as the logs 16 do not interfere with the operation of the gas ports 30 and so that the gas flames impinge directly on the logs 16, thereby simulating a wood burning fire. FIGS. 1 and 3 illustrate one possible arrangement of the logs 16 in which a front log 70 and rear log 72 are spaced apart to support the two top cross logs 74. The front and rear faces of the front log 70 generally project over the respective front gas ports 56 and rear gas port sections 60, 62, 64 so that the flames impinge directly thereon. Similarly, the front face of the rear log 72 generally projects over the rear gas port sections 60, 62, 64 permitting direct impingement of the flames. The top cross logs 74 are disposed on the front and rear logs 70, 72 so that the flames also impinge thereon. The logs 70, 72, 74 may be made of any conventional material but it is preferred that they be made of the light weight ceramic fiber which will simulate the glow of a burning log when heated.

Wood burning fireplaces typically have a grate for supporting the burning logs above the fireplace floor and providing adequate air circulation for combustion. In order to simulate such a grate and to provide assistance in the proper orientation of the artificial logs 16, the present gas burner system 12 may have a plurality of brackets 78, 82 such as illustrated in FIGS. 2–3, and a plurality of brackets 122 such as illustrated in FIGS. 6–8. In the embodiment illustrated in FIGS. 2–3, front and rear brackets 78, 82 are rigidly attached to the front and rear of the outer shell 21, respectively. In order to assist in the proper orientation of the front log 70, the front brackets 78 have a front flange 79 projecting upwards at the front edge of the outer shell 21 and a rear flange 80 projecting upwardly at the front edge of the rear gas ports 30. Thus, when the front log 70 is place in the front bracket 78, the front portion of the front log 70 is disposed near the front edge of the outer shell 21 so that is above the front gas port section 56 and the rear portion of the front log 70 is disposed above or near the rear gas port sections 60, 62, 64, thereby facilitating flame impingement on the log 70. Similarly, the rear bracket 82 has a front flange 83 which is disposed near the rear edge of the rear gas port sections 60, 62, 64 in order to facilitate flame impingement on the rear log 72. Similar brackets 122 may be provided in the second embodiment as illustrated in FIGS. 6–8.

I claim as my invention:

1. A gas burner pan for supporting logs in a gas fireplace comprising:

a gas tight shell having a gas inlet for receiving gas, a top panel for supporting the logs thereon and having a plurality of gas ports disposed therein for producing flames, the shell defining a burner plenum subjacent the gas ports and in communication with the gas inlet for receiving gas therein and distributing the gas to the gas ports and means within said shell for defining at least one dead air space substantially free of gas for minimizing the volume of the burner plenum.

2. The burner pan as set forth in claim 1 comprising an inner member adapted to fit within and sealably engage an outer shell for forming the dead air space therebetween.

3. The burner pan as set forth in claim 1 wherein the shell comprises a top member and a bottom member sealably connected to the top member, and an inner member disposed within the shell and sealably connecting the shell for forming the dead air space therebetween and at least one burner plenum.

4. The burner pan as set forth in claim 2 wherein the outer shell comprises a bottom plate and a hat-shaped top member having a top panel, opposing front and back panels, and opposing end panels for sealably connecting the bottom plate so that the bottom plate and the top member define the outer peripheral walls of the burner plenum and the inner shell comprises a top panel, opposing front and back panels, and opposing end panels for sealably engaging the outer shell for defining the dead air space therebetween and the inner peripheral walls of the burner plenum.

5. The burner pan as set forth in claim 1 wherein some of the gas ports are disposed in discrete and spaced sections for producing flames having selected sizes, shapes and concentrations to simulate a natural wood burning fire.

6. The burner pan as set forth in claim 5 wherein the outer burner pan has some flame sections disposed at the rear of the top panel generating relatively concentrated flames separated by other flame sections generating relatively sparse flames.

7. The burner pan as set forth in claim 5 wherein some of the gas ports are disposed on the top panel for generating a flame at the front of the outer shell.

8. The burner pan as set forth in claim 1 wherein the burner plenum is disposed along the outer periphery of the top panel and has a generally O-shaped configuration in plan view and the dead air space is disposed in the center of the burner plenum.

9. The burner pan as set forth in claim 1 wherein the outer shell has a generally V-shaped cross section and a base for supporting the outer shell, the top panel has a generally V-shaped cross section and at least two inner members adapted to fit within and sealably engage the outer shell for forming dead air spaces therebetween.

10. The burner pan as set forth in claim 9 wherein the burner plenum is disposed along the outer periphery and the middle of the top panel to form a generally O-shaped configuration with a middle portion through the center of the O-shape in plan view and two dead air spaces disposed in the center of the burner plenum and separated by the middle portion.

11. A gas burner system for use in a gas fireplace comprising:

a gas tight outer shell having a gas inlet for receiving gas, a top panel for supporting a plurality of logs thereon and having a plurality of gas ports disposed therein for producing flames, the outer shell defining a burner plenum subjacent the gas ports and in communication with the gas inlet for receiving gas therein and distributing the gas to the gas ports and containing an inner shell defining at least one dead air space substantially free of gas for minimizing the volume of the burner plenum.

12. The burner pan as set forth in claim 11 comprising an inner member adapted to fit within and sealably engage the outer shell for forming the dead air space therebetween.

13. The burner pan as set forth in claim 11 wherein the outer shell comprises a top member, a bottom member sealably connected to the top member and an inner member disposed within the outer shell and sealably connecting the outer shell for forming the dead air space therebetween and at least one burner plenum.

14. The burner pan as set forth in claim 12 wherein the outer shell comprises a bottom plate and a hat-shaped top member having a top panel, opposing front and back panels, and opposing end panels for sealably connecting the bottom plate so that the bottom plate and the top member define the outer peripheral walls of the burner plenum and the inner shell comprises a top panel, opposing front and back panels, and opposing end panels for sealably engaging the outer shell for defining the dead air space therebetween and the inner peripheral walls of the burner plenum.

15. The burner pan as set forth in claim 11 wherein some of the gas ports are disposed in discrete and spaced sections for producing flames having selected sizes, shapes and concentrations to simulate a natural wood burning fire.

16. The burner pan as set forth in claim 15 wherein the outer burner pan has some flame sections disposed at the rear of the top panel generating relatively concentrated flames separated by other flame sections generating relatively sparse flames.

17. The burner pan as set forth in claim 15 wherein some of the gas ports are disposed on the top panel for generating a flame at the front of the outer shell.

18. A gas burner system as set forth in claim 17 wherein some of the gas ports in the top panel are disposed for generating a flame that impinges on a substance that simulates glowing embers and on at least one of the logs.

19. A gas burner system as set forth in claim 15 wherein some of the gas ports are disposed at the rear of the top panel for generating a flame that impinges directly on at least one log.

20. The burner pan as set forth in claim 11, wherein the burner plenum is disposed along the outer periphery of the top panel and has a generally O-shaped configuration in the top plan view and the dead air space is disposed in the center of the burner plenum.

* * * * *

UNITED STATES PATENT AND TRADEMARK OFFICE

CERTIFICATE OF CORRECTION

PATENT NO. : 5,328,356

DATED : July 12, 1994

INVENTOR(S) : Eric Hawkinson

It is certified that error appears in the above-indentified patent and that said Letters Patent is hereby corrected as shown below:

Col. 3, line 20, after "long" insert --as--.

Col. 8, line 35, after "3", delete ",".

In the Abstract, line 15, after "gas"., insert

--In order to provide a realistic simulation of a wood burning fire, the gas burner has a plurality of gas ports disposed on the top panel in discretely distributed sections to generate concentrated flames in some sections and relatively sparse flames in other sections like a natural wood burning fire. The flame concentration and distribution generated by each section can be varied and controlled by the arrangement, the number and the size of the gas ports. The gas burner system has a front trough containing vermiculite to generate a glowing ember appearance when the front flame is directed over the top of the vermiculite trough. The gas ports and logs are arranged so that the gas flames directly impinge on the logs.--

Signed and Sealed this

Twenty-first Day of February, 1995

*Attest:*

Bruce Lehman

BRUCE LEHMAN

*Attesting Officer*

*Commissioner of Patents and Trademarks*